US011050182B2

(12) United States Patent
Ohfuku et al.

(10) Patent No.: US 11,050,182 B2
(45) Date of Patent: Jun. 29, 2021

(54) CONNECTOR WITH A LOCKING RETAINER

(71) Applicant: YAZAKI CORPORATION, Tokyo (JP)

(72) Inventors: Ryosuke Ohfuku, Makinohara (JP); Tomoyoshi Fukaya, Makinohara (JP); Takahiro Ohmoto, Wako (JP); Masaru Shinmura, Wako (JP); Yu Saito, Wako (JP); Yuki Goto, Wako (JP); Takashi Endo, Wako (JP); Kazuyuki Iwashita, Wako (JP); Kazuhide Ikeya, Makinohara (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 16/804,006

(22) Filed: Feb. 28, 2020

(65) Prior Publication Data

US 2020/0203877 A1 Jun. 25, 2020

Related U.S. Application Data

(63) Continuation of application No. PCT/JP2018/032329, filed on Aug. 31, 2018.

(30) Foreign Application Priority Data

Aug. 31, 2017 (JP) ..... JP2017-168022

(51) Int. Cl.
*H01R 13/436* (2006.01)
*H01R 13/627* (2006.01)

(52) U.S. Cl.
CPC ..... *H01R 13/4362* (2013.01); *H01R 13/6272* (2013.01); *H01R 13/6275* (2013.01)

(58) Field of Classification Search
CPC ..... H01R 13/4362; H01R 13/6272; H01R 13/6275

(Continued)

(56) References Cited

U.S. PATENT DOCUMENTS

| | | | | |
|---|---|---|---|---|
| 10,680,376 | B2 * | 6/2020 | Shimizu | H01R 13/4361 |
| 2003/0073353 | A1 * | 4/2003 | Endo | H01R 13/4362 439/752 |

(Continued)

FOREIGN PATENT DOCUMENTS

| | | | |
|---|---|---|---|
| CN | 1607699 | A | 4/2005 |
| JP | 2003-123892 | A | 4/2003 |
| JP | 2017-54674 | A | 3/2017 |

*Primary Examiner* — Alexander Gilman
(74) *Attorney, Agent, or Firm* — Kenealy Vaidya LLP

(57) ABSTRACT

A connector includes a housing having a terminal receiving chamber having an opening on one or both of opposite sides in a preset direction crossing an insertion direction of a connection terminal; and a side retainer having a pair of opposed plate portions disposed in positions to sandwich the housing from the opposite sides in the preset direction. The side retainer is attached laterally to the housing and movably supported on the housing to move between a temporary locking position to temporarily lock the connection terminal and a formal locking position to formally lock the connection terminal. One or both of the opposed plate portions of the side retainer covers one or both of the opposite sides of the terminal receiving chamber when the side retainer locates at the formal locking position.

6 Claims, 10 Drawing Sheets

(58) Field of Classification Search
USPC ..... 439/752
See application file for complete search history.

(56) References Cited

U.S. PATENT DOCUMENTS

| | | | | |
|---|---|---|---|---|
| 2003/0087563 | A1* | 5/2003 | Endo | H01R 13/4362 439/752 |
| 2005/0085126 | A1* | 4/2005 | Sagawa | H01R 13/4365 439/595 |
| 2013/0273764 | A1* | 10/2013 | Kitajima | H01R 13/4362 439/345 |
| 2015/0038022 | A1* | 2/2015 | Kataoka | H01R 13/426 439/752 |
| 2015/0099404 | A1* | 4/2015 | Iida | H01R 13/506 439/752 |
| 2017/0025780 | A1* | 1/2017 | Kida | H01R 13/5219 |
| 2017/0069983 | A1* | 3/2017 | Ohfuku | H01R 13/4361 |

* cited by examiner

CONNECTOR WITH A LOCKING RETAINER

CROSS-REFERENCE TO RELATED APPLICATIONS

This is a continuation of International Application No. PCT/JP2018/032329 filed on Aug. 31, 2018, and claims priority from Japanese Patent Application No. 2017-168022 filed on Aug. 31, 2017, the entire content of which is incorporated herein by reference.

BACKGROUND

The present invention relates to a connector.

Patent Literature 1 describes a side spacer to be attached laterally to a housing body of a connector. The side spacer is constituted by a plate-like outer member, and a branch plate to be inserted into a terminal receiving chamber from a side portion of the housing body. The outer member includes a side plate, an upper plate and a lower plate with which the housing body is covered when the side spacer is attached to the housing body. The branch plate is provided with a terminal temporary locking lance and a terminal formal locking portion. When a female terminal is inserted into the terminal receiving chamber of the housing body in a state where the side spacer is temporarily locked to the housing body, the female terminal is temporarily locked to the terminal temporary locking lance of the side spacer. After that, when the side spacer is formally locked to the housing body, the female terminal is formally locked to the terminal formal locking portion of the side spacer. Incidentally, the same literature includes a drawing illustrating a state where an upper plate and a lower plate of the housing body defining the upper and lower sides of the terminal receiving chamber have been covered with the upper plate and the lower plate of the outer member of the side spacer from above and below.

As for details of the above protector, refer to Patent Literature 1, JP-A-2003-123892.

SUMMARY

In the connector according to Patent Literature 1, the female terminal and the branch plate of the side spacer overlap each other vertically in the terminal receiving chamber of the housing body, and the upper plate and the lower plate of the housing body defining the upper and lower sides of the terminal receiving chamber are covered with the upper plate and the lower plate of the outer member of the side spacer from above and below. In this manner, a plurality of components overlap each other vertically in the aforementioned connector. It is therefore difficult to miniaturize the connector in the height direction.

An object of the present invention is to provide a connector which can be miniaturized.

Embodiments of a connector according to the present invention provide the following item (1) to (3).

(1) A connector comprising:

a housing having a terminal receiving chamber having an opening on one or both of opposite sides in a preset direction crossing an insertion direction of a connection terminal; and a side retainer having a pair of opposed plate portions disposed in positions to sandwich the housing from the opposite sides in the preset direction, the side retainer being attached laterally to the housing and movably supported on the housing to move between a temporary locking position to temporarily lock the connection terminal and a formal locking position to formally lock the connection terminal, one or both of the opposed plate portions of the side retainer covering one or both of the opposite sides of the terminal receiving chamber upon the side retainer being at the formal locking position, the side retainer including a front plate portion disposed on a front side of the housing in the insertion direction to connect front end portions of the pair of the opposed plate portions to each other.

According to a first aspect of the invention, relating to the item (1), of the opposed plate portions of the side retainer, one on the one side or both on the opposite sides in the predetermined direction close the terminal receiving chamber on the one side or the opposite sides at the formal locking position. Accordingly, of plates of the housing, one on the one side or two on the opposite sides can be removed, and, of the opposite plate portions of the side retainer, one on the one side or both on the opposite sides can be disposed at the positions from which the plates of the housing have been removed. It is therefore possible to miniaturize the connector in the aforementioned predetermined direction in comparison with a case where a side retainer is attached to a housing which closes a terminal receiving chamber on the opposite sides in the predetermined direction.

(2) The connector according to the item (1), wherein the opposed plate portion of the side retainer covering the terminal receiving chamber at the formal locking position includes a temporary locking portion to temporarily lock the connection terminal in the terminal receiving chamber at the temporary locking position and a formal locking portion to formally lock the connection terminal in the terminal receiving chamber at the formal locking position, the housing includes a rear locking portion to lock at least a rear end portion of the opposed plate portion of the side retainer at the temporary locking position to regulate the rear end portion of the opposed plate portion from moving outward in the preset direction, the opposed plate portion at the temporary locking position is pressed by the connection terminal through the temporary locking portion and bent outward in the preset direction to allow insertion of the connection terminal when the connection terminal is inserted into the terminal receiving chamber.

According to a second aspect of the invention, relating to the item (2), of the opposed plate portions of the side retainer, the opposed plate portion closing the terminal receiving chamber at the formal locking position (hereinafter referred to as a closing opposed plate portion) includes a temporary locking portion that temporarily locks the connection terminal, and a formal locking portion that formally locks the connection terminal. In a state where the side retainer is set at the temporary locking position, the rear end portion of the closing opposed plate portion is locked to the rear locking portion of the housing so as to be regulated from moving outward in the predetermined direction, while the front end portion of the closing opposed plate portion is supported on the housing through the front plate portion and the opposed plate portion on the opposite side so as to be regulated from moving outward in the predetermined direction. In this manner, in the state where the side retainer is set at the temporary locking position, the closing opposed plate portion is supported on the front end side and on the rear end side, so that the closing opposed plate portion can be bent suitably outward in the predetermined direction when the connection terminal is inserted into the terminal receiving chamber. Thus, the connection terminal can be inserted even if the temporary locking portion of the closing opposed plate portion is not bent largely. It is therefore possible to miniaturize the connector in the front/rear direction without providing a cantilever-like temporary locking portion that can be bent long and largely in the front/rear direction.

(3) The connector according to the item (2), wherein the housing includes a front locking portion to lock at least the front end portion of the opposed plate portion at the temporary locking position to regulate the front end portion of the opposed plate portion from moving outward in the preset direction.

According to a third aspect of the invention, relating to the item (3), in the state where the side retainer is set at the temporary locking position, the front end portion of the closing opposed plate portion is locked to the front locking portion of the housing so as to be regulated from moving outward in the predetermined direction. Accordingly, when the closing opposed plate portion is bent, influence thereof on the opposed plate portion on the opposite side through the front plate portion can be suppressed. Thus, elastic deformation in the opposed plate portions of the side retainer on the opposite sides in the predetermined direction can be controlled individually.

According to the present invention, a connector can be miniaturized.

BRIEF DESCRIPTION OF DRAWINGS

FIG. 8B showing a temporary locking position.

DETAILED DESCRIPTION

Figure 1:
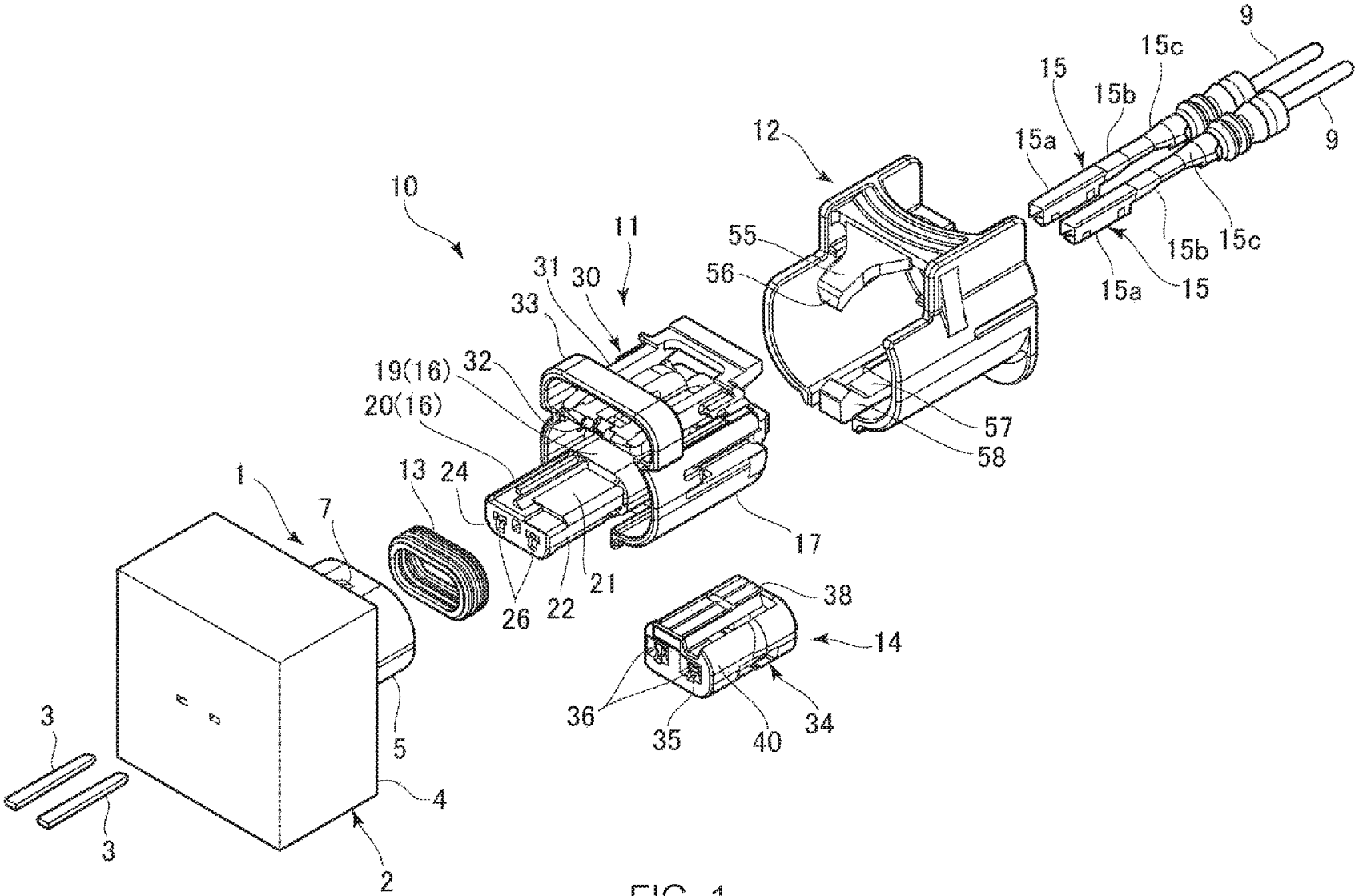
FIG. 1 is an exploded perspective view of a female connector according to a first embodiment of the present invention.
Figure 2:
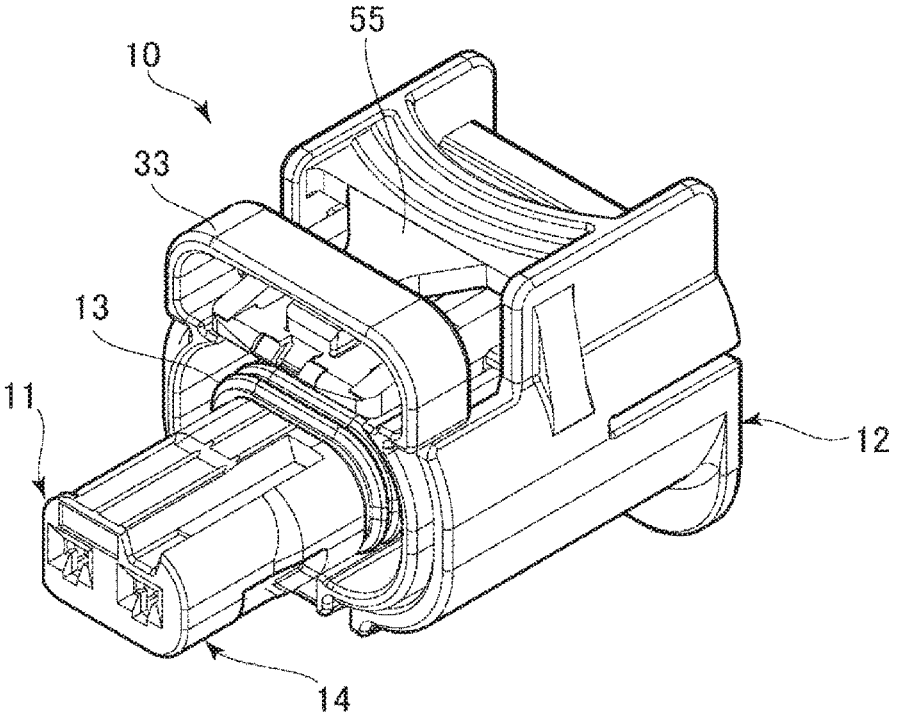
FIG. 2 is an external perspective view of the female connector.
Figure 3:
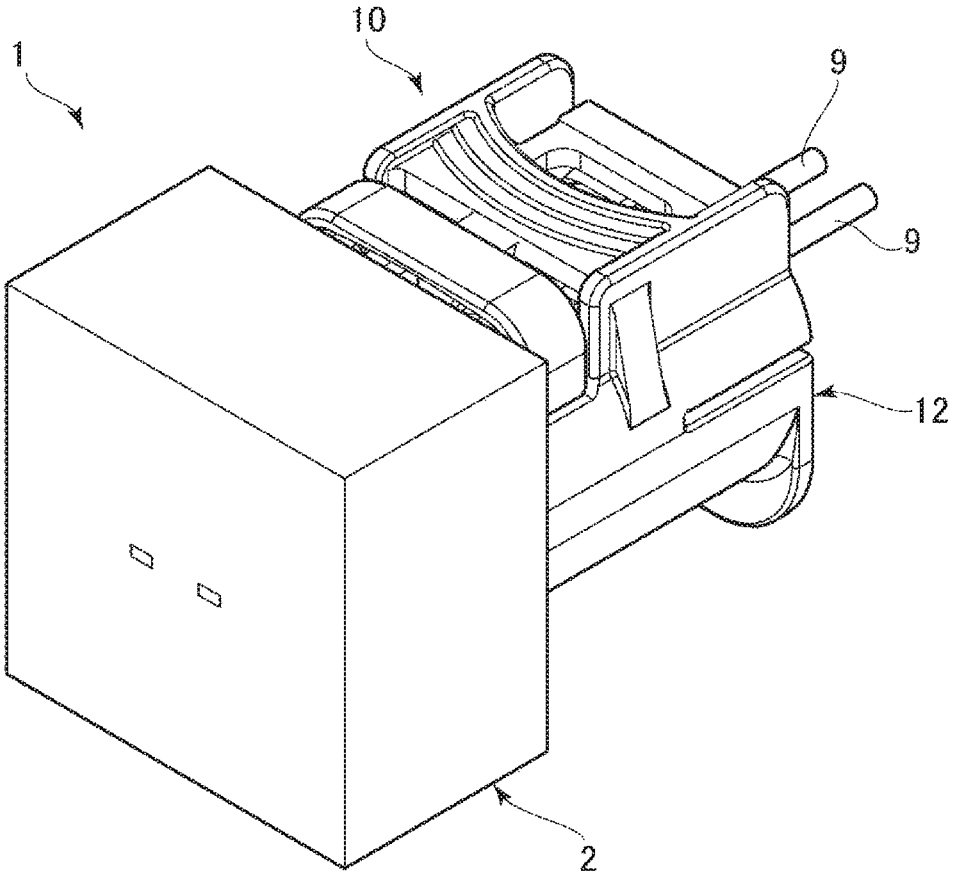
FIG. 3 is an external perspective view of a CPA formal locking state.
Figure 4:
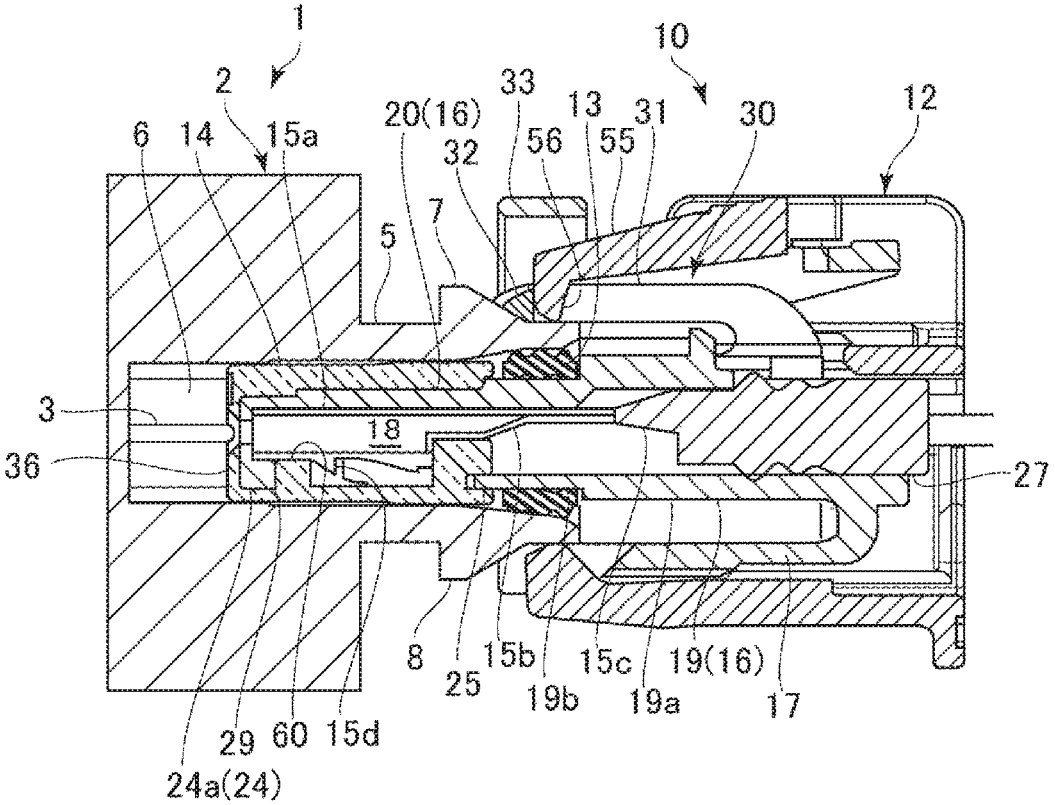
FIG. 4 is a longitudinally sectional view before fitting in the connector.
Figure 5:
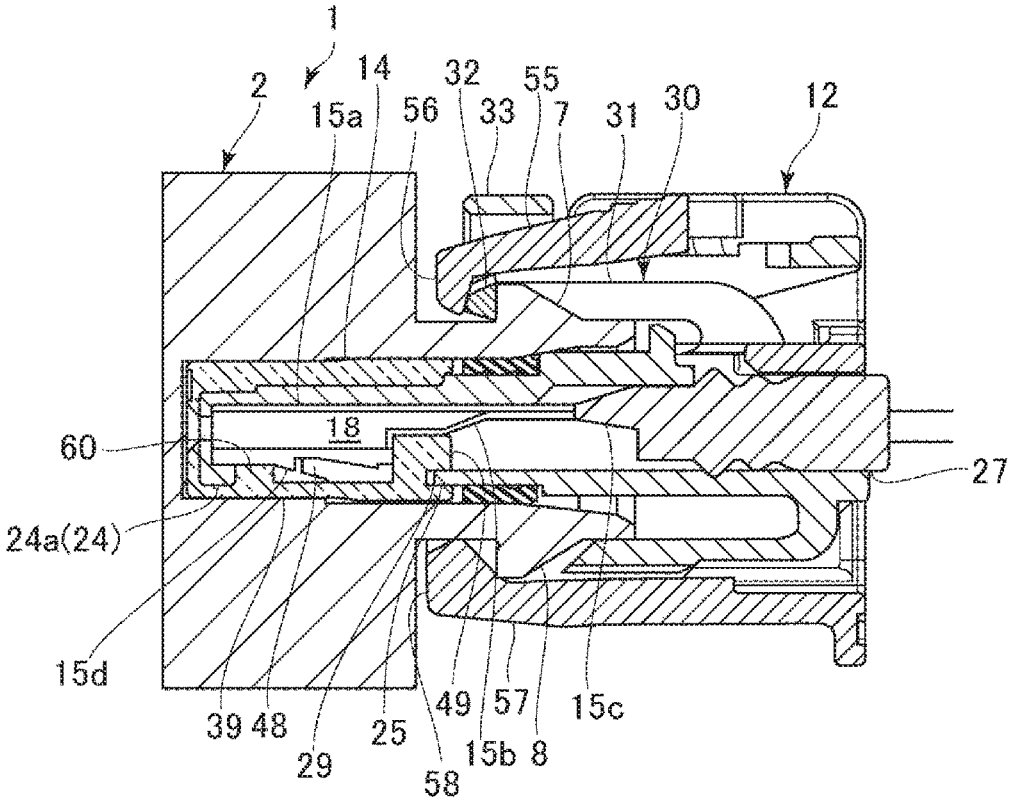
FIG. 5 is a longitudinally sectional view of the CPA formal locking state.

A first embodiment of a connector for carrying out the present invention will be described below with reference to the drawings. FIG. 1 is an exploded perspective view of a male connector 1 and a female connector 10 according to the embodiment; FIG. 2 is an external perspective view of the female connector 10 in which a CPA 12, a seal member 13 and a side retainer 14 have been attached to a female housing 11; FIG. 3 is an external perspective view of a CPA formal locking state; FIG. 4 is a longitudinally sectional view of a state before fitting in the connector; and FIG. 5 is a longitudinally sectional view of the CPA formal locking state, Incidentally, the following description will be made on the assumption that the direction of fitting with a partner connector is a front side (front in the fitting direction); the direction of leaving the partner connector is a rear side (rear in the fitting direction); one side (lower in FIG. 4) in the connector height direction (height direction) substantially perpendicular to the fitting direction is a lower side, and the other side (upper in FIG. 4) is an upper side; and the connector width direction (width direction) substantially perpendicular to the fitting direction and the connector height direction is a left/right direction.

(Schematic Configuration of Female Connector 10)

As shown in FIG. 1 to FIG. 3, the female connector (connector) 10 includes a cylindrical female housing (housing) 11, female terminals (connection terminals) 15 received in the female housing 11 in the fitting direction, a cylindrical CPA (fitting assuring member) 12 attached to the external surface of the female housing 11 slid ably in the fitting direction, an annular seal member 13 attached to the female housing 11, and a side retainer 14 attached to the female housing 11. The female connector 10 is a connector which can be fitted to the male connector 1. In a state where the female connector 10 and the male connector 1 have been fitted to each other, the female terminals 15 received in the female housing 11 are electrically connected to male terminals 3 received in a male housing 2 of the male connector 1. In the embodiment, a pair of female terminals 15 are provided in the female connector 10, a pair of male terminals 3 are provided in the male connector 1, and the pair of female terminals 15 and the pair of male terminals 3 are connected to each other respectively.

(Male Housing 2)

The male housing 2 is made of synthetic resin. The male housing 2 is connected directly to an apparatus wall of a not-shown electric apparatus which is, for example, mounted on a vehicle or the like. As shown in FIG. 1, the male housing 2 has a proximal end portion 4 corresponding to the apparatus wall, and a cylindrical hood portion 5 extending in the fitting direction from the proximal end portion 4. As shown in FIG. 4, a bottomed space 6 having an inner circumferential surface which is axially continuous to the inner circumferential surface of the hood portion 5 is formed in the proximal end portion 4. The tab-like male terminals 3 protruding in the fitting direction are fixed on the back side of the space 6. In the upper surface of the outer circumference of the hood portion 5, an upper locking protrusion 7 is provided to protrude. In the lower surface of the outer circumference of the hood portion 5, a lower locking protrusion 8 is provided to protrude. In FIG. 5, the male terminals 3 are not shown.

(Female Terminal 15)

Each female terminal 15 integrally has an electric contact portion 15*a* on the distal end side, a neck portion 15*b* at the rear of the electric contact portion 15*a*, and a calking portion 15*c* at the rear of the neck portion 15*b*. The calking portion 15*c* is connected to an electric wire 9. The electric contact portion 15*a* has a temporary locking protrusion 15*d* (see FIG. 4) protruding downward. The electric contact portion 15*a* is formed cylindrically so that the tab-like male terminal 3 can be inserted thereto. The neck portion 15*b* is formed to be narrower than the electric contact portion 15*a*.

(Female Housing 11)

The female housing 11 is made of synthetic resin. As shown in FIG. 4 and FIG. 5, the female housing 11 is formed by a cylindrical inner housing 16 and a cylindrical outer housing 17 which is put to surround an outer circumferential surface of the inner housing 16 at a distance from the outer circumferential surface. The hood portion 5 of the male housing 2 is inserted to a gap between the outer circumferential surface of the inner housing 16 and the inner circumferential surface of the outer housing 17. The front end side of the inner housing 16 is formed to project more frontward than the front end face of the outer housing 17. That is, the inner housing 16 includes a rear region 19 extending in the front/rear direction inside the outer housing 17, and an angularly cylindrical front region 20 projecting more frontward than the outer housing 17. The side retainer 14 is attached to the front region 20 of the inner housing 16.

The rear region 19 of the inner housing 16 has a large diameter portion 19*a*, and a small diameter portion 19*b* on the front end side. The large diameter portion 19*a* is formed to be slightly smaller than the space 6 of the male housing 2. The small diameter portion 19*b* is formed to be smaller than the large diameter portion 19*a*. The seal member 13 is attached to the cylindrical outer circumferential surface of the small diameter portion 19*b*.

The front region 20 of the inner housing 16 to which the side retainer 14 has been attached is inserted into the space 6 of the male housing 2. A female terminal receiving chamber (terminal receiving chamber) 18 to which the two female terminals 15 can be inserted from the rear is provided in the front region 20 of the inner housing 16. The female terminal receiving chamber 18 communicates with a terminal insertion port 27 at the rear end of the rear region 19 of the inner housing 16. The electric contact portions 15*a* and parts (front end portions) of the neck portions 15*b* of the female terminals 15 are received in the female terminal receiving chamber 18 of the front region 20 of the inner housing 16.

Figure 6:
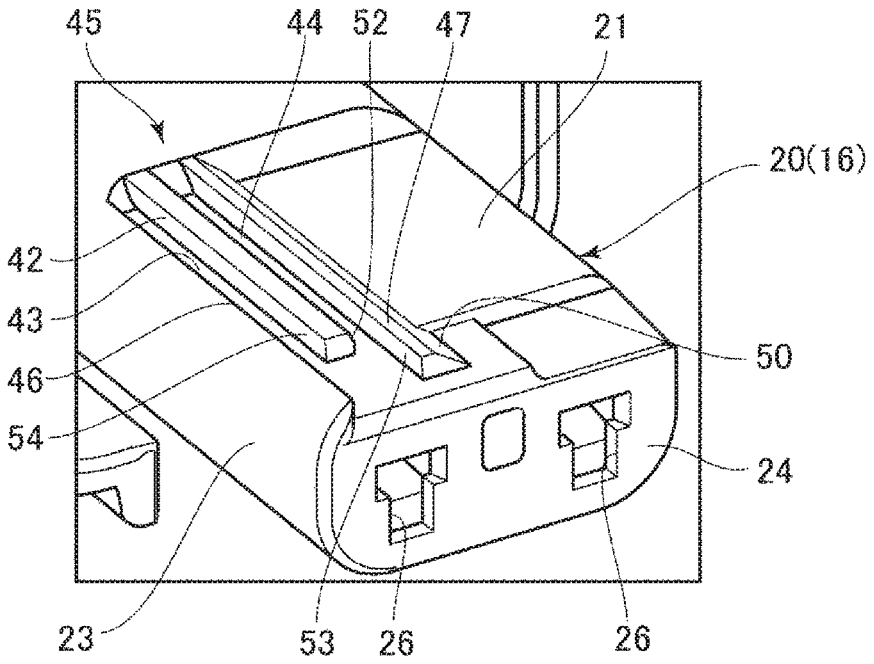
FIG. 6 is a perspective view of a front region of an inner housing.

As shown in FIG. 4 to FIG. 6, the front region 20 of the inner housing 16 has a housing upper plate portion 21, left and right housing side plate portions 22 and 23 (see FIG. 1), a housing front plate portion 24, and a rear locking convex portion (rear locking portion) 25. The front region 20 is formed into an angular cylinder. The housing upper plate portion 21 has a partition wall 28 (see FIG. 8) which projects downward from the lower surface of the housing upper plate portion 21 so as to partition the female terminal receiving chamber 18 to left and right. The housing upper plate portion 21 defines the upper side of the female terminal receiving chamber 18. That is, the female terminal receiving chamber 18 is partitioned into two left and right female terminal receiving chambers by the partition wall 28 of the housing upper plate portion 21. The left and right housing side plate portions 22 and 23 define the left and right opposite sides of the female terminal receiving chamber 18. The housing front plate portion 24 has a female terminal support portion 24*a* projecting rearward along the lower edge portion of the housing front plate portion 24. The housing front plate portion 24 defines the front side of the female terminal receiving chamber 18. The female terminal support portion 24*a* of the housing front plate portion 24 supports, from below, the front end portions of the female terminals 15 inserted into the female terminal receiving chamber 18. A pair of left and right male terminal insertion ports 26 are formed in the housing front plate portion 24 so as to penetrate the housing front plate portion 24 in the front/rear direction. The male terminals 3 are inserted into the female terminal receiving chamber 18 through the left and right male terminal insertion ports 26, from the front. The rear locking convex portion 25 projects frontward from the front lower end of the rear region 19 of the inner housing 16 and extends all over the width of the inner housing 16. The female terminal support portion 24*a* of the housing front plate portion 24 and the rear locking convex portion 25 are disposed to be separated at a large distance from each other in the front/rear direction. The lower surface of the female terminal support portion 24*a* of the housing front plate portion 24 and the lower surface of the rear locking convex portion 25 are disposed substantially at the same height position so as to constitute a lower surface 37 (see FIG. 9) of the front region 20 of the inner housing 16. Lower edges 22*a* and 23*a* of the left and right housing side plate portions 22 and 23 are disposed on the upper side from the lower surface 37 of the front region 20 of the inner housing 16. A housing opening 29 which opens the female terminal receiving chamber 18 downward is formed among the rear end of the female terminal support portion 24*a* of the housing front plate portion 24, the front end of the rear locking convex portion 25, and the lower edges 22*a* and 23*a* of the left and right housing side plate portions 22 and 23. That is, the female housing 11 defines the female terminal receiving chamber 18 which is opened on the lower side (one side, outer side) in the upper/lower direction (predetermined direction) crossing the insertion direction (from the rear side toward the front side in the embodiment) of the female terminals 15.

As shown in FIG. 6, a locking groove group 45 including a formal locking groove 43 and a temporary locking groove 44 extending in parallel with a partition 42 therebetween is provided in the upper surface of the housing upper plate portion 21 of the front region 20 of the inner housing 16. The partition 42, the formal locking groove 43 and the temporary locking groove 44 extend like straight lines in the fitting direction. The formal locking groove 43 is defined between a side wall upper end portion 46 of the housing upper plate portion 21 protruding from the upper surface of the housing upper plate portion 21 and the partition 42. The temporary locking groove 44 is defined between a groove forming protrusion 47 protruding from the upper surface of the housing upper plate portion 21 and the partition 42.

As shown in FIG. 4 and FIG. 5, a housing arm 30 which can be elastically deformed is formed in the outer circumferential surface of the female housing 11. The housing arm 30 is formed like a gate. The housing arm 30 has a pair of left and right elastic arm pieces 31 and a locking piece 32. Each of the elastic arm pieces 31 is supported like a cantilever on the outer circumferential surface of the female housing 11 (the large diameter portion 19*a* of the rear region 19 of the inner housing 16) so as to extend toward the male housing 2 and substantially in parallel to the outer circumferential surface of the inner housing 16. The locking piece 32 bridges front end portions of the elastic arm pieces 31 to each other in the width direction. When the two housings 2 and 11 are fitted to each other, the locking piece 32 is locked to the upper locking protrusion 7 of the male housing 2.

The outer housing 17 has a female housing bridge 33 which rises up from the opposite left and right ends of a front end upper portion of the outer housing 17, crosses the front end upper portion in the width direction, and covers the locking piece 32 of the housing arm 30 from the outside (upper). The female housing bridge 33 is disposed in a position where the locking piece 32 is allowed to be elastically deformed by the upper locking protrusion 7 of the male housing 2, and near and outside (upper side) the movable region of the locking piece 32.

(Side Retainer 14)

Figure 7:
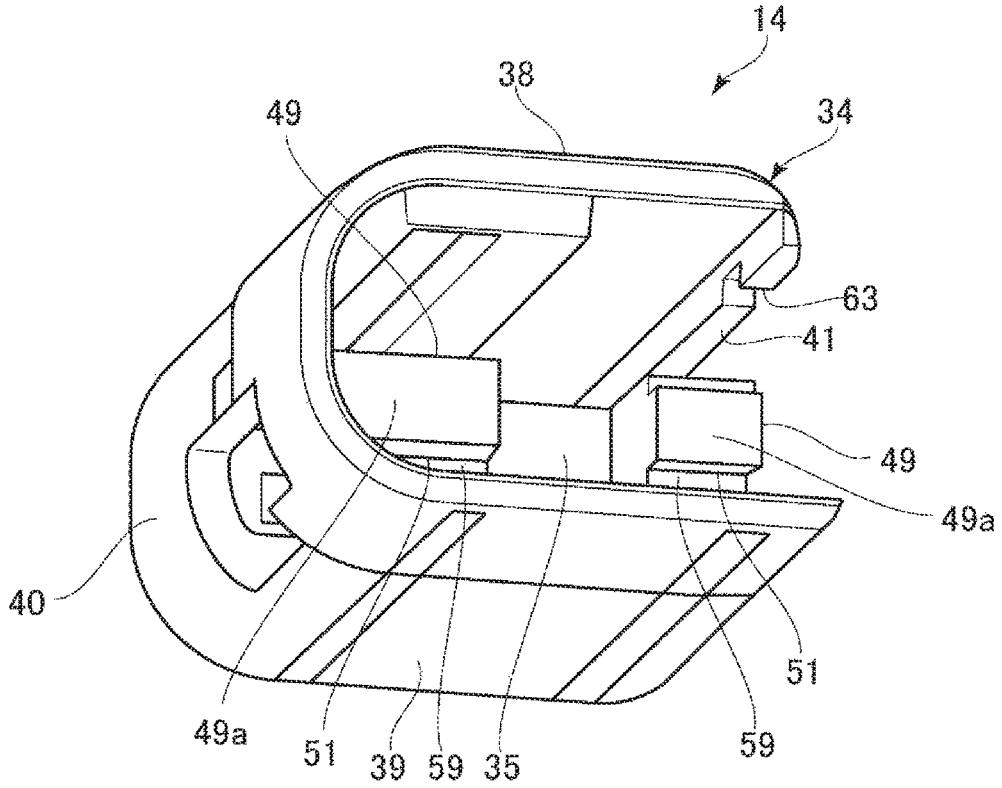
FIG. 7 is a perspective view of a side retainer.

The side retainer 14 is made of synthetic resin. As shown in FIG. 1 and FIG. 7, the side retainer 14 has a retainer body 34 which is opened on one side (lateral side) in the width direction, and a retainer front plate portion (front plate portion) 35 which covers the front end of the retainer body 34. The side retainer 14 is attached to the front region 20 of the inner housing 16 from the width direction (attachment direction). The side retainer 14 can be set at a formal locking position (see FIG. 8A) where the side retainer 14 is perfectly attached to the front end region 20 of the inner housing 16, and a temporary locking position (see FIG. 8B) closer than the formal locking position in the attachment direction. Two male terminal insertion ports 36 are formed in the retainer front plate portion 35. In a state where the side retainer 14 is set at the formal locking position (regular position), the retainer front plate portion 35 is positioned in front of the housing front plate portion 24 of the inner housing 16 so as to approach or touch the housing front plate portion 24. Thus, the male terminal insertion ports 36 communicate with the male terminal insertion ports 26 of the inner housing 16. The male terminals 3 are inserted from the male terminal insertion ports 26 and 36 and connected to the electric contact portions 15*a* of the female terminals 15 in the female terminal receiving chamber 18.

The retainer body 34 has a retainer upper plate portion (opposed plate portion) 38, a retainer lower plate portion (opposed plate portion, closing opposed plate portion) 39 and a retainer curved plate portion 40 integrally. The retainer upper plate portion 38 and the retainer lower plate portion 39 are separated vertically so as to be opposed to each other. The retainer curved plate portion 40 connects a side edge of the retainer upper plate portion 38 and a side edge of the retainer lower plate portion 39 continuously. In the state where the side retainer 14 is set at the formal locking position, the retainer upper plate portion 38 and the retainer lower plate portion 39 are positioned to hold the front region 20 of the inner housing 16 from opposite sides in the upper/lower direction. Incidentally, in the embodiment, although the retainer curved plate portion 40 is provided as a side plate portion connecting the side edge of the retainer upper plate portion 38 and the side edge of the retainer lower plate portion 39 continuously, a side plate portion which is not curved may be provided.

A retainer protrusion 41 extending like a straight line in the fitting direction is provided to protrude downward at an edge of the retainer upper plate portion 38 on the opening (opening on the opposite side of the retainer curved plate portion 40) side. A notch 63 is formed at a rear end portion of the retainer protrusion 41 so that a jig (not shown) can be inserted thereto. The jig is used when the side retainer 14 is moved from the formal locking position to the temporary locking position.

Figure 9:
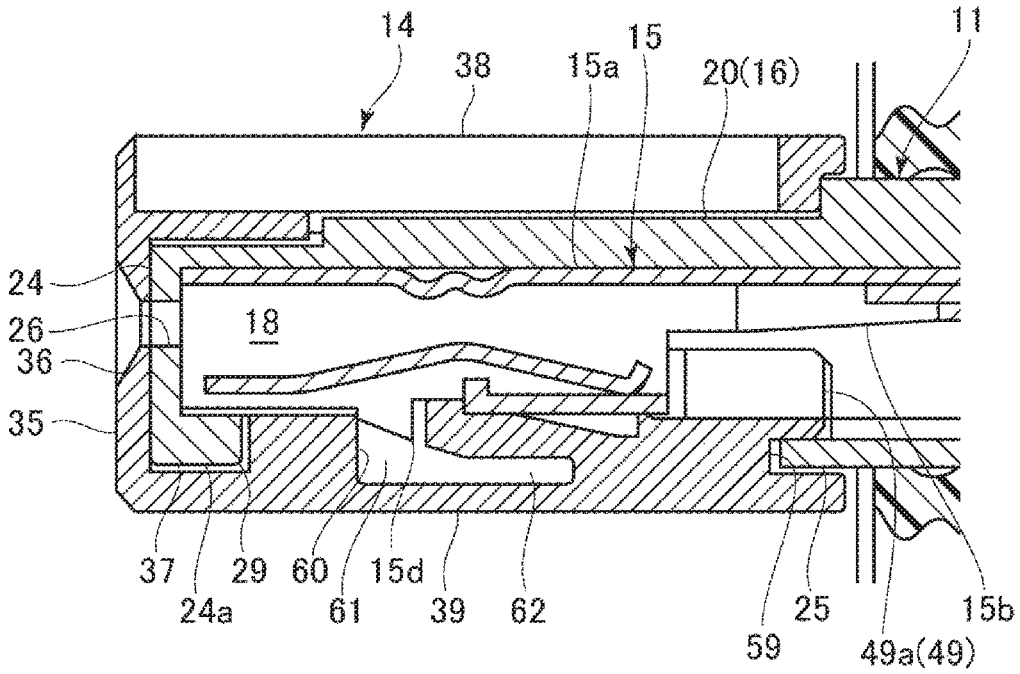
FIG. 9 is a sectional view of FIGS. 8A and 8B viewed from the arrow direction of IX-IX.

As shown in FIG. 5, FIG. 7 and FIG. 9, the retainer lower plate portion 39 has a female terminal support portion 60 on the front end side, two temporary locking claws (temporary locking portions) 48 in an intermediate portion, and two formal locking pieces (formal locking portions) 49 on the rear end side.

In the state where the side retainer 14 is mounted at the formal locking position on the front region 20 of the inner housing 16, the female terminal support portion 60 is disposed at the rear of the female terminal support portion 24*a* of the housing front plate portion 24 so that the front face of the female terminal support portion 60 extends in the width direction while facing and approaching or touching the rear face of the female terminal support portion 24*a*. The upper face of the female terminal support portion 60 is disposed substantially on the same height position as the upper face of the female terminal support portion 24*a* of the housing front plate portion 24. A space 61 having dimensions in which the temporary locking protrusions 15*d* of the female terminals 15 can be disposed is defined at the rear of the female terminal support portion 60. The female terminal support portion 60 supports, from below, the front end portions of the electric contact portions 15*a* of the female terminals 15 received in the female terminal receiving chamber 18.

The temporary locking claws 48 are cantilever-like claws which are disposed substantially in the intermediate portion of the retainer lower plate portion 39 in the front/rear direction so as to project tilting frontward and upward from the upper surface of the retainer lower plate portion 39. In the state where the side retainer 14 is set at the temporary locking position, the temporary locking claws 48 temporarily lock the temporary locking protrusions 15*d* of the female terminals 15. A space 62 for allowing the temporary locking claws 48 to be flexurally deformed downward is defined under the temporary locking claws 48. The space 62 under the temporary locking claws 48 communicates with a lower portion of the space 61 at the rear of the female terminal support portion 60 from the rear side thereof. In the state where the side retainer 14 is set at the temporary locking position, the temporary locking claws 48 are disposed under the female terminal receiving chamber 18 on the opposite sides of the partition wall 28 (see FIG. 8) of the housing upper plate portion 21.

The formal locking pieces 49 are structures projecting upward from the upper face of the retainer lower plate portion 39 and disposed in the rear end portion of the retainer lower plate portion 39 so as to formally lock step parts between the electric contact portions 15*a* and the neck portions 15*b* of the female terminals 15 in the state where the side retainer 14 is set at the formal locking position. In the state where the side retainer 14 is set at the formal locking position, the formal locking pieces 49 are disposed under the female terminal receiving chamber 18 on the opposite sides of the partition wall 28 (see FIG. 8) of the housing upper plate portion 21. That is, the formal locking pieces 49 and the temporary locking claws 48 are disposed in positions different from each other in the width direction and in the front/rear direction. Notch portions 51 notched frontward and extending in the width direction are formed respectively in the lower end portions on rear face 49*a* sides of the two formal locking pieces 49. The two notch portions 51 of the formal locking pieces 49 and the upper face of the retainer lower plate portion 39 form and define rear slide rails 59 recessed frontward and extending in the width direction. The rear slide rails 59 are formed to be large enough to allow the rear locking convex portion 25 of the inner housing 16 to be inserted thereto.

Figure 8A:
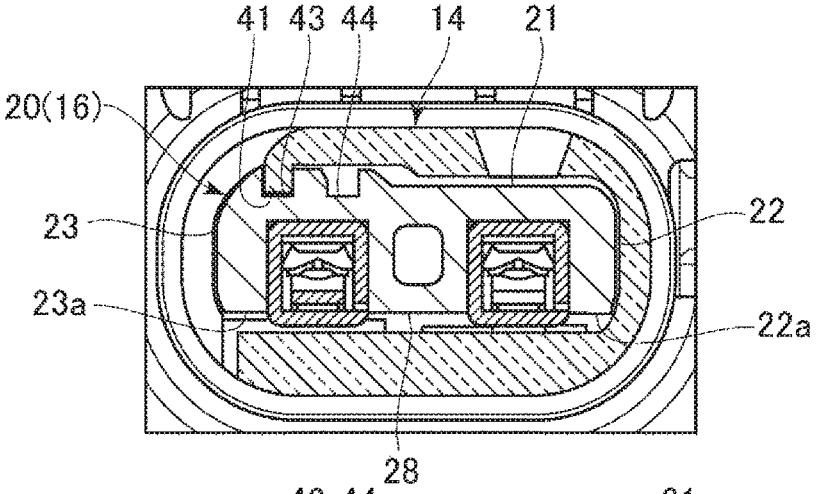
FIGS. 8A and 8B are longitudinally sectional view of the front region of the inner housing and the side retainer, FIG. 8A showing a formal locking position.
Figure 8B:
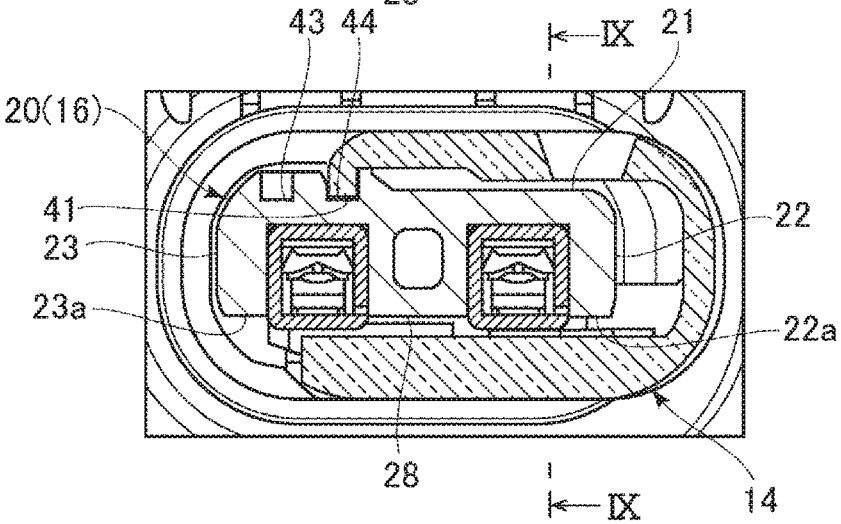

When the side retainer 14 is attached to the front region 20 of the inner housing 16, an opening at a side of the side retainer 14 is slightly expanded, and the slide rails 59 in the rear end portion of the retainer lower plate portion 39 are engaged with the rear locking convex portion 25 of the inner housing 16, The front region 20 of the inner housing 16 is inserted into the side retainer 14 through the opening so as to move the side retainer 14 in the width direction (attachment direction), When the side retainer 14 is moved in the attachment direction, the retainer protrusion 41 enters the temporary locking groove 44 to be thereby locked (in the temporary locking position) as shown in FIG. 8B, When the side retainer 14 is further moved in the attachment direction, the retainer protrusion 41 enters the formal locking groove 43 to be thereby locked (in the formal locking position) as shown in FIG. 8A. Since the rear locking convex portion 25 extends all over the width of the inner housing 16, the rear slide rails 59 of the side retainer 14 can be engaged with the rear locking convex portion 25 of the inner housing 16 immediately after the side retainer 14 begins to be attached.

After that, the rear slide rails 59 keep the engaged state until the retainer protrusion 41 reaches the formal locking position. The side retainer 14 slides and moves in the width direction in the state where vertical movement of the rear end portion of the side retainer 14 is regulated by the engagement of the rear locking convex portion 25 of the inner housing 16 with the rear slide rails 59.

As shown in FIG. 6, a side face of the groove forming protrusion 47 of the housing upper plate portion 21 outside the groove is a first slope 50 which is gentle. When the side retainer 14 is pushed in the attachment direction, the retainer protrusion 41 slides on the first slope 50 comparatively easily so that the side retainer 14 is bent and gets over the groove forming protrusion 47. Thus, the side retainer 14 is mounted at the temporary locking position. A side face of the partition 42 on the temporary locking groove 44 side is a second slope 52 which is slightly steeper than the first slope 50. When the side retainer 14 is pushed more strongly than when it is mounted at the temporary locking position, the retainer protrusion 41 slides on the second slope 52 so that the side retainer 14 is bent and gets over the partition 42. Thus, the side retainer 14 moves from the temporary locking position to the formal locking position.

On the other hand, a side face of the groove forming protrusion 47 of the housing upper plate portion 21 on the temporary locking groove 44 side and a side face of the partition 42 on the formal locking groove 43 side are vertical faces 53 and 54. Even if the side retainer 14 is pulled simply in a removal direction (an opposite direction to the attachment direction), the side retainer 14 cannot be moved from the formal locking position to the temporary locking position or removed from the temporary locking position easily.

The partition 42 is shorter than the retainer protrusion 41. On the front end side of the locking groove group 45, the partition 42 is partially absent so that the formal locking groove 43 and the temporary locking groove 44 have the same groove depth and communicate with each other. Alternatively, the partition 42 on the front end side of the locking groove group 45 may be formed to be lower in height than any other region (a central portion and a rear end portion).

(CPA 12)

The CPA 12 is made of synthetic resin. As shown in FIG. 1 and FIG. 4, the CPA 12 is spread over the female housing 11 from the rear and attached thereto slidably in the fitting direction. A CPA upper arm 55 like a cantilever is formed in the CPA 12 so as to extend toward the male housing 2. An upper locking claw 56 is formed in a distal end portion of the CPA upper arm 55 so as to extend inward substantially in the vertical direction. The upper locking claw 56 swings upward (outward) with a rear end portion of the CPA upper arm 55 as a fulcrum so that the CPA upper arm 55 can be elastically deformed (flexurally deformed). In the embodiment, when the CPA 12 is attached to the female housing 11, the upper locking claw 56 of the CPA upper arm 55 abuts against a rear end portion of the locking piece 32 of the housing arm 30 so as to press the rear end portion of the locking piece 32 in the fitting direction (frontward) when the two housings 2 and 11 are fitted to each other.

The CPA 12 has a CPA lower arm 57 which is supported like a cantilever in a position facing the CPA upper arm 55 (a position away therefrom by about 180 degrees), The CPA lower arm 57 extends toward the male housing 2. A lower locking claw 58 extending toward the inside of the CPA 12 is formed in a distal end portion of the CPA lower arm 57, In the same manner as the CPA upper arm 55, the lower locking claw 58 swings downward (outward) with a rear end portion of the CPA lower arm 57 as a fulcrum so that the CPA lower arm 57 can be elastically deformed (flexurally deformed).

(Attachment Procedure of Female Terminals 15)

Next, the attachment procedure of the female terminals 15 according to the embodiment will be described.

To attach the female terminals 15 into the female housing 11, first, as shown in FIG. 8B and FIG. 9, the side retainer 14 is set at the temporary locking position on the front region 20 of the inner housing 16. In the temporary locking position, the temporary locking claws 48 of the retainer lower plate portion 39 of the side retainer 14 are disposed under the female terminal receiving chamber 18 on the opposite sides of the partition wall 28 of the housing upper plate portion 21. In the state where the side retainer 14 is set at the temporary locking position, the first female terminal 15 is inserted into the female terminal receiving chamber 18 through the terminal insertion port 27 at the rear end of the rear region 19 of the inner housing 16. When the electric contact portion 15*a* of the female terminal 15 is inserted into the female terminal receiving chamber 18 of the front region 20 of the inner housing 16, the temporary locking protrusion 15*d* projecting downward from the electric contact portion 15*a* abuts against the temporary locking claw 48 of the retainer lower plate portion 39 from the rear so as to press the temporary locking claw 48 and the retainer lower plate portion 39 downward. The front end side of the retainer lower plate portion 39 is supported on the housing upper plate portion 21 through the retainer front plate portion 35 and the retainer upper plate portion 38 so as to be regulated from moving downward, while the rear end side of the retainer lower plate portion 39 is regulated from moving downward by the engagement between the rear slide rails 59 and the rear locking convex portion 25 of the inner housing 16. Accordingly, when the temporary locking protrusion 15*d* of the female terminal 15 presses the temporary locking claw 48 and the retainer lower plate portion 39 downward, the intermediate portion of the retainer lower plate portion 39 in the front/rear direction is bent downward so as to allow frontward movement (insertion) of the female terminal 15. The female terminal 15 moves frontward and the distal end of the female terminal 15 abuts against the housing front plate portion 24. When the temporary locking protrusion 15*d* of the female terminal 15 gets frontward over the temporary locking claw 48 of the retainer lower plate portion 39, the retainer lower plate portion 39 which has been bent is restored so that the temporary locking claw 48 of the retainer lower plate portion 39 is disposed behind the temporary locking protrusion 15*d* of the female terminal 15 to thereby temporarily lock the first female terminal 15 and regulate rearward movement of the female terminal 15. In the state where the first female terminal 15 has been temporarily locked, the second female terminal 15 is inserted into the female terminal receiving chamber 18 and temporarily locked in the same manner as the first female terminal 15. Since the second female terminal 15 is inserted into the female terminal receiving chamber 18 in the state where the first female terminal 15 has been temporarily locked, the first female terminal 15 can be prevented from dropping off during the insertion of the second female terminal 15.

Next, as shown in FIG. 8A, the side retainer 14 is moved from the temporary locking position to the formal locking position relatively to the front region 20 of the inner housing 16. When the side retainer 14 is moved from the temporary locking position to the formal locking position, the formal locking pieces 49 of the retainer lower plate portion 39 of the side retainer 14 move in the width direction toward the rear sides (the step parts with the neck portions 15*b*) of the electric contact portions 15*a* of the two female terminals 15. That is; in the formal locking position, the formal locking pieces 49 of the retainer lower plate portion 39 are disposed at the rears of the rear faces of the electric contact portions 15*a* of the two female terminals 15 so as to formally lock the two female terminals 15 and regulate the two female terminals 15 from moving rearward. Thus, the female terminals 15 are attached into the female housing 11.

(Side Retainer 14 at Formal Locking Position)

Next, the relationship between the side retainer 14 and the inner housing 16 at the formal locking position will be described. Incidentally, although FIG. 9 is a sectional view of the temporary locking position, the side retainer 14 has the same height-direction position relative to the inner housing 16 in the primary locking position. Therefore, the description will be made also with reference to FIG. 9.

As shown in FIG. 8A and FIG. 9, the retainer lower plate portion 39 of the side retainer 14 at the formal locking position closes the housing opening 29 under the female terminal receiving chamber 18 of the inner housing 16, from below. The female terminal support portion 60, the temporary locking claws 48 and the formal locking pieces 49 on the upper surface side of the retainer lower plate portion 39 at the formal locking position are disposed on the upper side from the lower surface 37 of the front region 20 of the inner housing 16 so as to project on the female terminal receiving chamber 18 side from the housing opening 29, The upper surface of the female terminal support portion 60 is disposed under the lower surfaces of the electric contact portions 15*a* of the female terminals 15 so as to approach or touch the lower surfaces of the electric contact portions 15*a*. The upper ends of the temporary locking claws 48 are disposed slightly above the lower surfaces of the electric contact portions 15*a*, The upper ends of the formal locking pieces 49 are disposed above the lower surfaces of the electric contact portions 15*a* and disposed under and near the lower surfaces of the neck portions 15*b*.

(Fitting Procedure of Female Connector 10)

Next, the fitting procedure of the female connector 10 according to the embodiment will be described. The following description will be made along the operation of the female connector 10 when the female housing 11 is made close to the male housing 2 of the male connector 1 connected directly to an apparatus wall of an electric apparatus by way of example.

First, the female terminals 15 are attached to the female housing 11 as described above. Next, when the female housing 11 is adjusted correspondingly to the position of the male housing 2 and the CPA 12 is pushed in the fitting direction (frontward), the CPA upper arm 55 abuts against the locking piece 32 so that the female housing 11 moves frontward together with the CPA 12. Thus, the inner housing 16 of the female housing 11 is inserted into the hood portion 5 of the male housing 2, and the distal end portions of the male terminals 3 are inserted into the male terminal insertion ports 36 (see FIG. 4).

When the CPA 12 is further pushed in the fitting direction, the locking piece 32 of the housing arm 30 gets over the upper locking protrusion 7 of the hood portion 5 of the male housing 2 so as to be locked to the upper locking protrusion 7. Thus, the two housings 2 and 11 are brought into a state (fitting state) where they are locked to each other. At the time when the fitting is thus completed, the upper locking claw 56 of the CPA upper arm 55 still stays on the slope of the upper locking protrusion 7, and the lower locking claw 58 of the CPA lower arm 57 also stays on the slope of the lower locking protrusion 8. Accordingly, the CPA 12 continuingly suffers reaction from the slope of the upper locking protrusion 7 due to the elastic deformation of the upper locking claw 56 and reaction from the slope of the lower locking protrusion 8 due to the elastic deformation of the lower locking claw 58.

Successively, the upper locking claw 56 of the CPA upper arm 55 moves in the fitting direction, and gets over the locking piece 32 locked to the upper locking protrusion 7. After that, the upper locking claw 56 is locked to the upper locking protrusion 7 while holding the locking piece 32 therebetween (CPA formal locked). Thus, in the state where the CPA upper arm 55 is locked to the upper locking protrusion 7, the two housings 2 and 11 are always locked. Therefore, the fitting between the two housings 2 and 11 is assured by the fitting of the CPA upper arm 55. In addition, since the locking piece 32 is held between the upper locking protrusion 7 and the upper locking claw 56, the female housing 11 is suppressed from dropping off. Incidentally, the lower locking claw 58 is locked to the lower locking protrusion 8 substantially at the same timing as the upper locking claw 56 is locked.

In this manner, according to the embodiment, the retainer lower plate portion 39 of the side retainer 14 at the formal locking position closes the housing opening 29 under the female terminal receiving chamber 18 of the inner housing 16, from below Therefore, the front region 20 of the female housing 11 can be constituted by the housing upper plate portion 21, the left and right housing side plate portions 22 and 23 and the housing front plate portion 24 so as to remove a lower plate portion (for example, a housing lower plate portion) and dispose the retainer lower plate portion 39 of the side retainer 14 therein. It is therefore possible to miniaturize the female connector 10 in the upper/lower direction (height direction) in comparison with a case where the side retainer 14 is attached to a female housing closing the female terminal receiving chamber 18 on the opposite sides in the upper/lower direction.

In addition, the front end side of the retainer lower plate portion 39 is supported on the housing upper plate portion 21 through the retainer front plate portion 35 and the retainer upper plate portion 38 so as to be regulated from moving downward, while the rear end side of the retainer lower plate portion 39 is regulated from moving downward by the engagement between the rear slide rails 59 and the rear locking convex portion 25 of the inner housing 16. In this manner, in the state where the side retainer 14 is set at the temporary locking position, the front end side and the rear end side of the retainer lower plate portion 39 are supported on the female housing 11 side so as to be regulated from moving downward. Accordingly, when the electric contact portions 15*a* of the female terminals 15 are inserted into the female terminal receiving chamber 18, the intermediate portion of the retainer lower plate portion 39 in the front/rear direction can be bent downward suitably. Thus, the female terminals 15 can be inserted without bending the cantilever-like temporary locking claws 48 of the retainer lower plate portion 39 downward largely. It is therefore unnecessary to form the cantilever-like temporary locking claws 48 to be long in the front/rear direction enough to be bent largely. Thus, the female connector 10 can be miniaturized in the front/rear direction.

Incidentally, although in the embodiment the front region 20 of the inner housing 16 opens the female terminal receiving chamber 18 downward (one side in a predetermined direction crossing the insertion direction of the female terminals 15), the direction to open the female terminal receiving chamber 18 is not limited thereto. For example, the female terminal receiving chamber 18 may be opened upward (one side) while the female terminal receiving chamber 18 is closed by the retainer upper plate portion 38. Alternatively, the female terminal receiving chamber 18 may be opened on one side in the width direction (one side in the predetermined direction crossing the insertion direction of the female terminals 15). In this case, the side retainer is formed to include a pair of opposed plate portions opposed to each other in the width direction, so that the opposed plate portion on the one side in the width direction closes the one side of the female terminal receiving chamber 18.

In addition, although in the embodiment the front region 20 of the inner housing 16 opens the female terminal receiving chamber 18 on one side (lower side in the embodiment) in a predetermined direction crossing the insertion direction of the female terminals 15, the female terminal receiving chamber 18 may be opened on the opposite sides in the predetermined direction (the opposite sides in the upper/lower direction or the opposite sides in the width direction). In this case, the opposite sides of the female terminal receiving chamber 18 may be closed by a pair of opposed plate portions of a side retainer while, of the pair of opposed plate portions of the side retainer, at least one opposed plate portion is provided with a temporary locking portion and a formal locking portion. In addition, in this case, the inner housing 16 may have a rear locking portion for regulating rearward movement of a rear end portion of the opposed plate portion provided with the temporary locking portion and the formal locking portion.

In addition, although in the embodiment the rear slide rails 59 recessed frontward are provided in the retainer lower plate portion 39 and the rear locking convex portion 25 projecting frontward is provided in the inner housing 16 so as to regulate downward movement of the rear end portion of the retainer lower plate portion 39 at the temporary locking position, the rear slide rails 59 and the rear locking convex portion 25 do not have to be provided.

In addition, although in the embodiment the rear slide rails 59 recessed frontward are provided in the retainer lower plate portion 39 and the rear locking convex portion 25 projecting frontward is provided in the inner housing 16 so as to regulate downward movement of the rear end portion of the retainer lower plate portion 39 at the temporary locking position, the present invention is not limited thereto. It will go well if the inner housing 16 has a rear locking portion which is disposed under a predetermined region of the rear end portion of the retainer lower plate portion 39 at least at the temporary locking position so as to regulate downward movement of the rear end portion of the retainer lower plate portion 39. For example, a rear locking convex portion projecting rearward may be provided in the retainer lower plate portion 39 while a rear slide rail (rear locking portion) recessed rearward is provided in the inner housing 16.

In addition, although in the embodiment the rear locking convex portion 25 extending all over the width of the inner housing 16 is provided and the rear slide rails 59 of the side retainer 14 are arranged to be engaged therewith since the side retainer 14 begins to be attached and until the side retainer 14 reaches the formal locking position, the present invention is not limited thereto. It will go well if the rear locking convex portion 25 of the inner housing 16 at least at the temporary locking position locks the rear slide rails 59 of the side retainer 14.

Next, a second embodiment of the present invention will be described with reference to the drawings. A female connector (connector) 70 in the embodiment is different from that in the first embodiment as to the shapes of the female terminal support portion 60 of the retainer lower plate portion 39 and the female terminal support portion 24*a* of the housing front plate portion 24 of the inner housing 16. Incidentally, similar constituents to those in the first embodiment are referenced correspondingly, and description thereof will be omitted.

Figure 10:
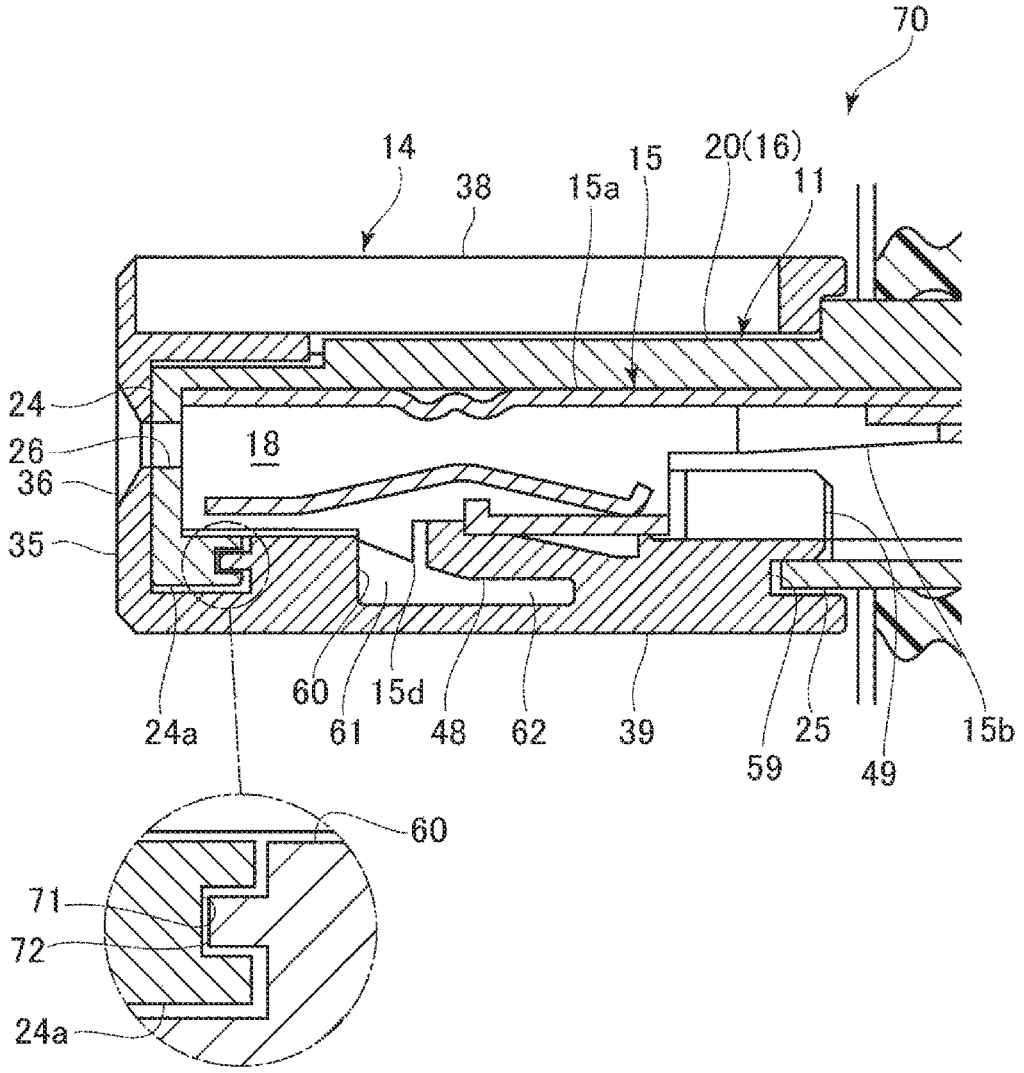
FIG. 10 is a longitudinally sectional view of a main portion of a female connector according to a second embodiment of the present invention.

As shown in FIG. 10, the female connector (connector) 70 has a cylindrical female housing 11, and a side retainer 14 attached to the female housing 11.

The female terminal support portion 24*a* of the housing front plate portion 24 of the inner housing 16 has a front slide rail (front locking portion) 71 recessed frontward from the rear surface thereof so as to extend in the width direction. The front slide rail 71 extends all over the width of the female terminal support portion 24*a*.

The female terminal support portion 60 of the retainer lower plate portion 39 of the side retainer 14 has a front locking convex portion 72 projecting frontward from the front surface thereof and extending in the width direction. The front locking convex portion 72 is disposed in a position corresponding to the front slide rail 71 of the housing front plate portion 24.

When the side retainer 14 is attached to the front region 20 of the inner housing 16, an opening at a side of the side retainer 14 is slightly expanded, and the rear slide rails 59 in the rear end portion of the retainer lower plate portion 39 are engaged with the rear locking convex portion 25 of the inner housing 16 while the front locking convex portion 72 of the front end portion of the retainer lower plate portion 39 is engaged with the front slide rail 71 of the housing front plate portion 24. The front region 20 of the inner housing 16 is inserted into the side retainer 14 through the opening so as to move the side retainer 14 in the width direction (attachment direction). Since the front slide rail 71 extends all over the width of the female terminal support portion 24*a*, the front locking convex portion 72 of the side retainer 14 can be engaged with the front slide rail 71 of the inner housing 16 as soon as the side retainer 14 begins to be attached. After that, the front locking convex portion 72 keeps the engagement until the side retainer 14 reaches the formal locking position. The front end portion of the side retainer 14 slides and moves in the width direction in the state where the movement thereof in the upper/lower direction is regulated by the engagement between the front locking convex portion 72 of the retainer lower plate portion 39 and the front slide rail 71 of the housing front plate portion 24.

In this manner, according to the embodiment, in the state where the side retainer 14 is set at the temporary locking position, the front end portion of the side retainer 14 is regulated from moving in the upper/lower direction (particularly downward (one side, outer side)) by the engagement between the front locking convex portion 72 of the retainer lower plate portion 39 and the front slide rail 71 of the housing front plate portion 24. Accordingly, when the female terminals 15 are inserted into the female terminal receiving chamber 18 so that the retainer lower plate portion 39 is bent downward, influence (input of force) on the retainer upper plate portion 38 through the retainer front plate portion 35 can be suppressed. Thus, elastic deformation in the retainer upper plate portion 38 and the retainer lower plate portion 39 of the side retainer 14 can be controlled individually. Therefore, plate thicknesses, shapes, etc. of the retainer upper plate portion 38 and the retainer lower plate portion 39 can be set easily.

Incidentally, in the embodiment, the front slide rail 71 is provided in the female terminal support portion 24*a* of the housing front plate portion 24, and the front locking convex portion 72 is provided in the female terminal support portion 60 of the retainer lower plate portion 39 so as to regulate downward movement of the front end portion of the retainer lower plate portion 39 at the temporary locking position. However, the present invention is not limited thereto. It will go well if the housing front plate portion 24 has a front locking portion which is disposed under a predetermined region of the front end portion of the retainer lower plate portion 39 at least at the temporary locking position so as to regulate downward movement of the front end portion of the retainer lower plate portion 39. For example, a front locking convex portion (front locking portion) projecting rearward may be provided in the female terminal support portion 24*a* of the housing front plate portion 24 while a front slide rail recessed rearward is provided in the female terminal support portion 60 of the retainer lower plate portion 39.

In addition, as described previously, the female terminal receiving chamber 18 may be opened on the opposite sides (on the opposite sides in the upper/lower direction or on the opposite sides in the width direction) in a predetermined direction (a direction crossing the insertion direction of the female terminals 15) while the opposite sides of the female terminal receiving chamber 18 in the predetermined direction are closed by a pair of opposed plate portions of a side retainer, and, of the pair of opposed plate portions of the side retainer, at least one opposed plate portion is provided with a temporary locking portion and a formal locking portion. In this case, the inner housing 16 may have a rear locking portion for regulating outward movement of a rear end portion of the opposed plate portion provided with the temporary locking portion and the formal locking portion, and a front locking portion for regulating outward movement of a front end portion of the same opposed plate portion.

In addition, in the embodiment, the front slide rail 71 is provided to extend all over the width of the female terminal support portion 24*a*, and the front locking convex portion 72 of the side retainer 14 is arranged so that the front locking convex portion 72 can be engaged since the side retainer 14 begins to be attached and until the side retainer 14 reaches the formal locking position. However, the present invention is not limited thereto. It will go well if the front slide rail 71 of the female terminal support portion 24*a* locks the front locking convex portion 72 of the side retainer 14 at least at the temporary locking position.

Incidentally, the present invention is not limited to the aforementioned embodiments, but various modifications can be used within the scope of the present invention. For example, the present invention is not limited to the aforementioned embodiments, but modifications, improvements, etc. can be made suitably. In addition thereto, materials, shapes, dimensions, numbers, arrangement places, etc. of constituent elements in the aforementioned embodiments are not limited, but any materials, any shapes, any dimensions, any numbers, any arrangement places, etc. may be used as long as the present invention can be attained.

For example, in the aforementioned embodiments, the cantilever-like temporary locking claws (temporary locking portion) 48 under which the space 62 is provided are provided to project tilting frontward and upward from the upper face of the retainer lower plate portion 39. However, the temporary locking portion is not limited thereto. For example, a temporary locking portion under which there is no space may be provided in the retainer lower plate portion 39 so as to project upward from the upper face of the retainer lower plate portion 39.

Here, the features of the aforementioned embodiments of the connector according to the present invention will be summarized and listed briefly in the following paragraphs [1] to [3].

[1] A connector (10) comprising:

a housing having a terminal receiving chamber having an opening on one or both of opposite sides in a preset direction crossing an insertion direction of a connection terminal; and a side retainer (14) having a pair of opposed plate portions (38, 39) disposed in positions to sandwich the housing from the opposite sides in the preset direction, the side retainer (14) being attached laterally to the housing and movably supported on the housing to move between a temporary locking position to temporarily lock the connection terminal and a formal locking position to formally lock the connection terminal, one or both of the opposed plate portions (38, 39) of the side retainer (14) covering one or both of the opposite sides of the terminal receiving chamber upon the side retainer (14) being at the formal locking position, the side retainer (14) including a front plate portion (35) disposed on a front side of the housing in the insertion direction to connect front end portions of the pair of the opposed plate portions (38, 39) to each other.

[2] The connector (10) according to the item [1], wherein the opposed plate portion of the side retainer (14) covering the terminal receiving chamber at the formal locking position includes a temporary locking portion to temporarily lock the connection terminal in the terminal receiving chamber at the temporary locking position and a formal locking portion to formally lock the connection terminal in the terminal receiving chamber at the formal locking position, the housing includes a rear locking portion to lock at least a rear end portion of the opposed plate portion of the side retainer (14) at the temporary locking position to regulate the rear end portion of the opposed plate portion from moving outward in the preset direction, the opposed plate portion at the temporary locking position is pressed by the connection terminal through the temporary locking portion and bent outward in the preset direction to allow insertion of the connection terminal when the connection terminal is inserted into the terminal receiving chamber.

[3] The connector (10) according to the item [2], wherein the housing includes a front locking portion to lock at least the front end portion of the opposed plate portion at the temporary locking position to regulate the front end portion of the opposed plate portion from moving outward in the preset direction.

A connector according to the present invention can be miniaturized. The present invention having this effect can be, for example, used for a connector structure with a fitting assuring member (CPA).

REFERENCE SIGNS LIST

10, 70 female connector (connector)
14 side retainer
15 female terminal (connection terminal)
18 female terminal receiving chamber (terminal receiving chamber)
25 rear locking convex portion (rear locking portion)
35 retainer front plate portion (front plate portion)
38 retainer upper plate portion (opposed plate portion)

39 retainer lower plate portion (opposed plate portion)
71 front slide rail (front locking portion)

The invention claimed is:

1. A connector comprising:

a housing having a terminal receiving chamber having an opening on one or both of opposite sides in a preset direction crossing an insertion direction of a connection terminal; and a side retainer having a pair of opposed plate portions disposed in positions to sandwich the housing from the opposite sides in the preset direction, the side retainer being attached laterally to the housing and movably supported on the housing to move between a temporary locking position to temporarily lock the connection terminal and a formal locking position to formally lock the connection terminal, one or both of the opposed plate portions of the side retainer covering one or both of the opposite sides of the terminal receiving chamber upon the side retainer being at the formal locking position, the side retainer including a front plate portion disposed on a front side of the housing in the insertion direction to connect front end portions of the pair of the opposed plate portions to each other, and one of the opposite plate portions of the side retainer covering the opening in one of the opposite sides of the terminal receiving chamber.

2. The connector according to claim 1, wherein the opposed plate portion of the side retainer covering the terminal receiving chamber at the formal locking position includes a temporary locking portion to temporarily lock the connection terminal in the terminal receiving chamber at the temporary locking position and a formal locking portion to formally lock the connection terminal in the terminal receiving chamber at the formal locking position, the housing includes a rear locking portion to lock at least a rear end portion of the opposed plate portion of the side retainer at the temporary locking position to regulate the rear end portion of the opposed plate portion from moving outward in the preset direction, the opposed plate portion at the temporary locking position is pressed by the connection terminal through the temporary locking portion and bent outward in the preset direction to allow insertion of the connection terminal when the connection terminal is inserted into the terminal receiving chamber.

3. The connector according to claim 2, wherein the housing includes a front locking portion to lock at least the front end portion of the opposed plate portion at the temporary locking position to regulate the front end portion of the opposed plate portion from moving outward in the preset direction.

4. The connector according to claim 1, wherein the front plate portion extends entirely across the front side of the side retainer in a width direction.

5. The connector according to claim 1, wherein the front plate portion is positioned in front of the housing so as to touch a front plate portion of the housing.

6. The connector according to claim 1, wherein the front plate portion includes two male terminal insertion ports formed therein.

* * * * *